US010344509B2

(12) United States Patent
Bledsoe

(10) Patent No.: US 10,344,509 B2
(45) Date of Patent: Jul. 9, 2019

(54) LATCH ASSEMBLY

(71) Applicant: Brett Bledsoe, Alvord, TX (US)

(72) Inventor: Brett Bledsoe, Alvord, TX (US)

( * ) Notice: Subject to any disclaimer, the term of this patent is extended or adjusted under 35 U.S.C. 154(b) by 452 days.

(21) Appl. No.: 15/147,014

(22) Filed: May 5, 2016

(65) Prior Publication Data

US 2016/0326783 A1 Nov. 10, 2016

Related U.S. Application Data

(60) Provisional application No. 62/157,210, filed on May 5, 2015.

(51) Int. Cl.

| | |
|---|---|
| ***E05B 65/00*** | (2006.01) |
| ***E05B 15/00*** | (2006.01) |
| ***E05C 3/16*** | (2006.01) |

(52) U.S. Cl.

CPC ..... *E05C 3/16* (2013.01); *E05B 15/00* (2013.01); *E05B 65/0007* (2013.01)

(58) Field of Classification Search

CPC ..... Y01S 292/29; Y10T 292/108; Y10T 292/1063; Y10T 292/1064; Y10T 292/107; Y10T 292/0937; Y10T 292/0938; Y10T 292/0941; Y10T 292/1006; Y10T 292/1007; Y10T 292/1011; Y10T 292/1013; E05B 65/0007

See application file for complete search history.

(56) References Cited

U.S. PATENT DOCUMENTS

| | | | | | |
|---|---|---|---|---|---|
| 97,934 | A | * | 12/1869 | Large | E05B 47/02 292/184 |
| 104,447 | A | * | 6/1870 | Goodrich | E05B 65/0007 292/42 |
| 487,077 | A | * | 11/1892 | Rapson | E05B 15/0093 292/230 |
| 815,553 | A | * | 3/1906 | Pettijohn | E05B 65/0007 292/189 |
| 861,406 | A | * | 7/1907 | Stetler | E05B 85/243 292/216 |
| 970,345 | A | * | 9/1910 | Munsinger | E05C 19/009 292/299 |
| 1,112,715 | A | * | 10/1914 | Miller | E05B 85/24 292/213 |
| 1,168,234 | A | * | 1/1916 | Tausch | E05B 85/243 292/216 |

(Continued)

OTHER PUBLICATIONS

Online advertisement for Sure-Latch Lockable Two-Way Livestock Gate Latch, updated Feb. 21, 2014, at http://www.beavervalleysupply.com/sectionj/collatch.htm.

*Primary Examiner* — Carlos Lugo
(74) *Attorney, Agent, or Firm* — James E. Walton

(57) ABSTRACT

A latch assembly comprises a backplate, a lock lever, and a latch member. The lock lever is operable by a user to unlock the latch assembly such that the latch member is free to rotate relative to the backplate and allow a gate to be opened. The lock lever is attached to the backplate and is free to move relative to the backplate for operation of the latch assembly. The latch member is attached to the backplate and is free to move relative to the backplate while the latch assembly is in an unlocked configuration, but is prohibited from to moving relative to the backplate by the lock lever while the latch assembly is in a locked configuration.

17 Claims, 9 Drawing Sheets

(56) References Cited

U.S. PATENT DOCUMENTS 1,177,487 A * 3/1916 Clements ..... E05B 59/00 292/341.15
1,179,852 A * 4/1916 Louden ..... E05B 15/0093 292/210
1,202,733 A * 10/1916 Kilmer ..... E05B 85/24 292/213
1,227,863 A * 5/1917 Winnega ..... E05B 85/24 292/213
1,280,653 A * 10/1918 Brady ..... E05B 85/243 292/216
1,450,443 A * 4/1923 Judge ..... E05B 65/0007 292/40
1,503,209 A * 7/1924 Rees ..... E05B 17/00 292/143
1,538,056 A * 5/1925 Olson ..... E05B 65/0007 292/213
1,711,743 A * 5/1929 Olson ..... E05B 65/0007 292/198
1,904,291 A * 4/1933 Neilson ..... A01K 1/0017 292/198
2,510,178 A * 6/1950 James ..... E05B 65/0007 292/211
3,043,617 A * 7/1962 Shelton ..... E05B 65/06 292/230
3,419,302 A * 12/1968 Frey ..... E05B 65/06 292/189
3,907,345 A * 9/1975 Martini ..... E05C 5/00 292/68
4,083,591 A * 4/1978 Parisien ..... E05B 65/06 292/202
4,111,475 A * 9/1978 McCormick ..... E05B 65/0007 292/207
4,135,747 A * 1/1979 Melilli ..... E05B 65/0007 292/175
4,355,829 A * 10/1982 Gregory ..... A01K 1/0017 292/216
4,592,578 A * 6/1986 Martin ..... E05B 65/06 292/148
2010/0156119 A1* 6/2010 Mueller ..... E05B 15/0205 292/126

* cited by examiner

LATCH ASSEMBLY

TECHNICAL FIELD

The present disclosure relates generally to systems and methods associated with latching devices suitable for securing in a closed position any closure element, such as a door, window, gate, or the like.

BRIEF DESCRIPTION OF THE DRAWINGS

Features, aspects, and embodiments of the present disclosure are described in conjunction with the attached drawings, in which.

Figure 1:
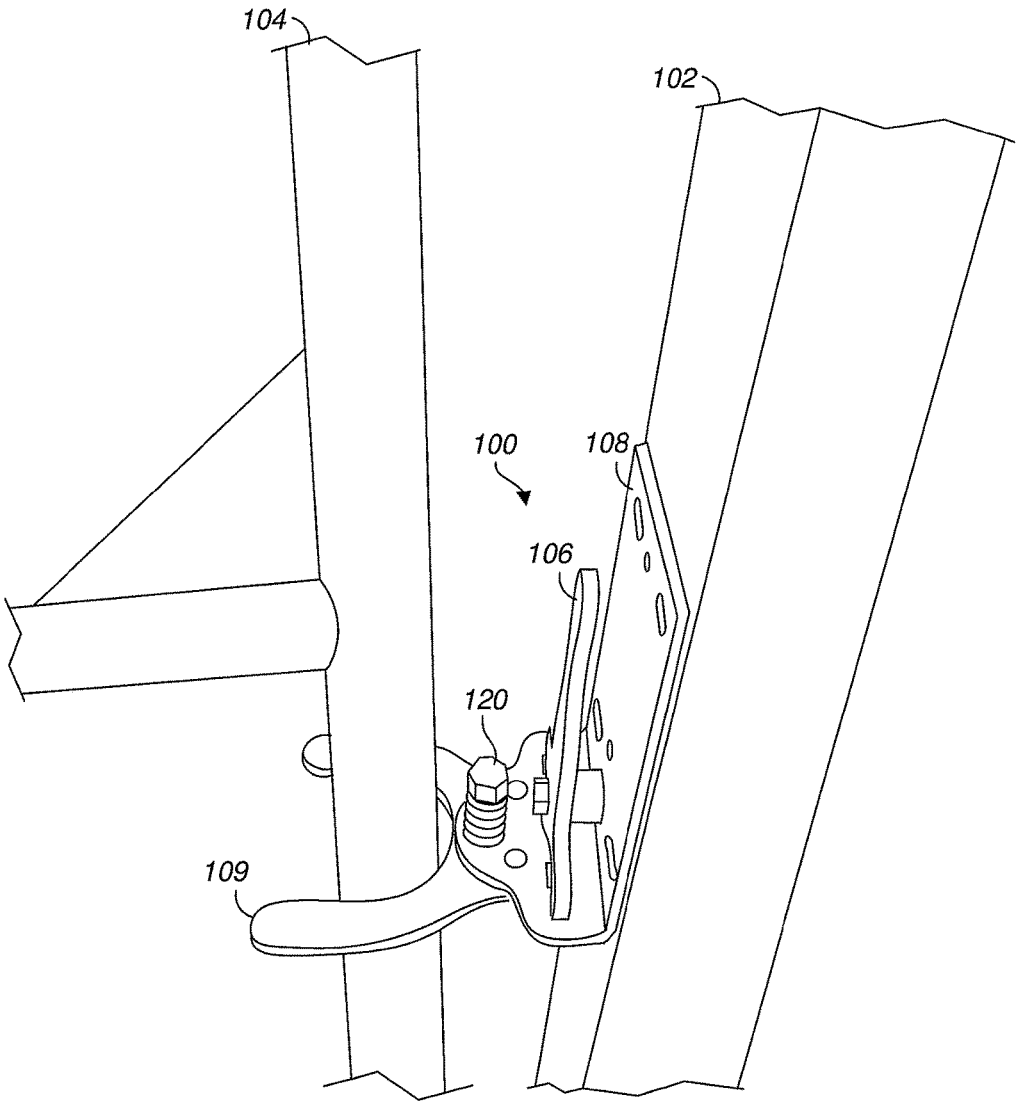
FIG. 1 shows a perspective view of a latch assembly according to a first embodiment of the present disclosure.

Where used in the various figures of the drawings, the same reference numerals designate the same or similar parts. Furthermore, when the terms "front," "back," "first," "second," "upper," "lower," "height," "top," "bottom," "outer," "inner," "width," "length," "end," "side," "horizontal," "vertical," and similar terms are used herein, it should be understood that these terms have reference only to the structure shown in the drawing and are utilized only to facilitate describing embodiments of the present disclosure.

All figures are drawn for ease of explanation of the basic teachings of the present disclosure only; the extensions of the figures with respect to number, position, relationship, and dimensions of the parts will either be explained or will be within the skill of persons of ordinary skill in the art after the following teachings of the present disclosure have been read and understood. Further, the exact dimensions and dimensional proportions to conform to specific width, length, and similar requirements will likewise be within the skill of the art after the following teachings of the present disclosure have been read and understood.

Embodiments of the latch assembly according to the present disclosure will now be described in detail with reference to the accompanying drawings.

DESCRIPTION OF THE PREFERRED EMBODIMENT

FIG. 1 shows a perspective view of a latch assembly 100 according to a first embodiment of the present disclosure. The latch assembly 100 is shown attached to a post 102 while a gate 104 is closed. The latch assembly 100 includes a lock lever 106, a backplate 108, and a latch member 109. With the backplate 108 securing the latch assembly 100 to a post or the like, and while the lock lever 106 is centered and upright as shown in FIG. 1, the latch member 109 is rigidly held in place and prevented from pivoting relative to the backplate 108, thereby allowing the latch assembly 100 to hold the gate 104 closed. A person can operate the lock lever 106 to free the latch member 109 so that the latch member 109 is free to pivot (about pivot bolt 120) relative to the backplate 108, thereby allowing the gate 104 to swing open.

While the following description includes a description of a specific exemplary embodiment including specific dimensions and materials thereof, the exemplary embodiment is disclosed only as a non-limiting example of one implementation of the disclosed latch assembly and is not intended to limit the present disclosure to the dimensions and materials disclosed in connection with the exemplary embodiment.

Figure 2A:
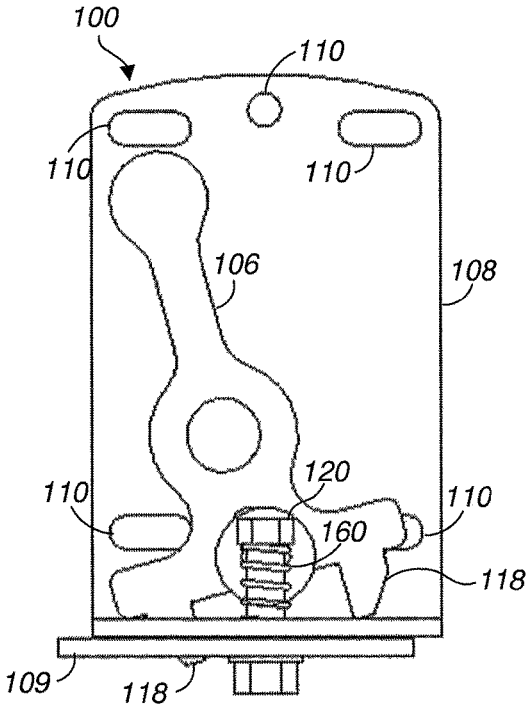
FIGS. 2A, 2B, and 2C respectively show front, side, and top views of a latch assembly according to a first embodiment of the present disclosure.
Figure 2B:
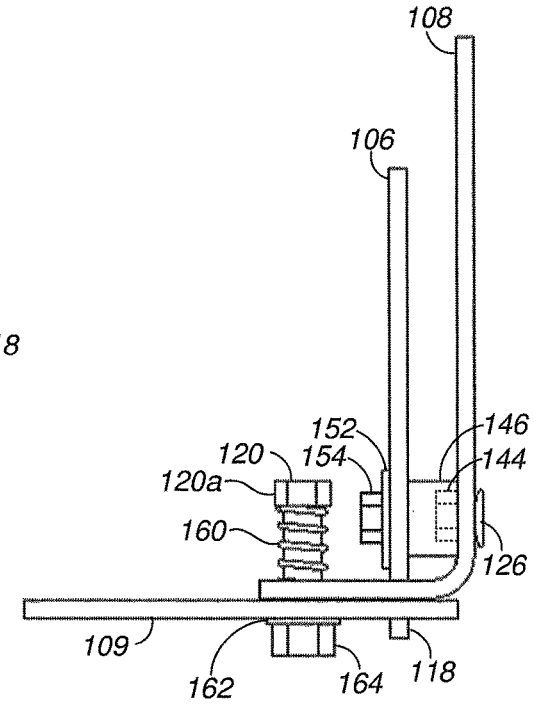
Figure 2C:
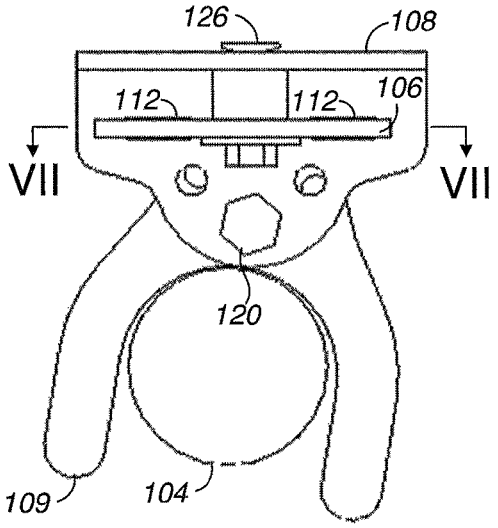

FIGS. 2A, 2B, and 2C respectively show front, side, and top views of the latch assembly 100 with the lock lever 106 is a tilted position so that the latch member 109 is free to pivot relative to the backplate 108. The latch assembly 100 constitutes an embodiment of a gate latch as disclosed herein, although the latch assembly 100 can be used for applications other than gates, such as doors or windows.

Figure 3A:
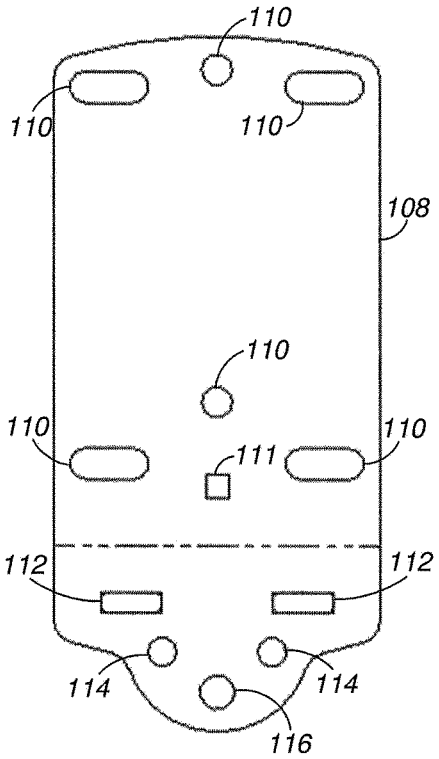
FIGS. 3A, 3B, and 3C respectively show top-front, front, and side views of a backplate of the latch assembly shown in FIG. 1 according to a first embodiment of the present disclosure.
Figure 3B:
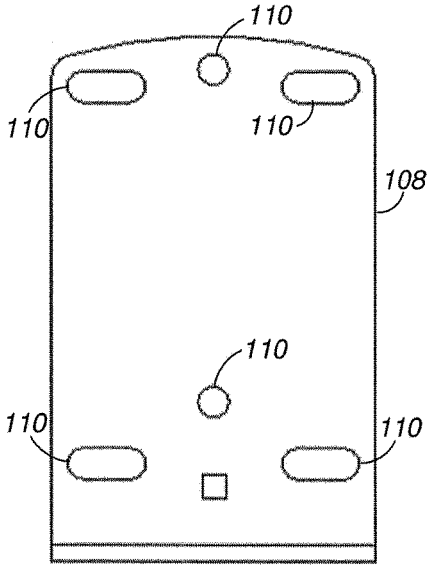
Figure 3C:
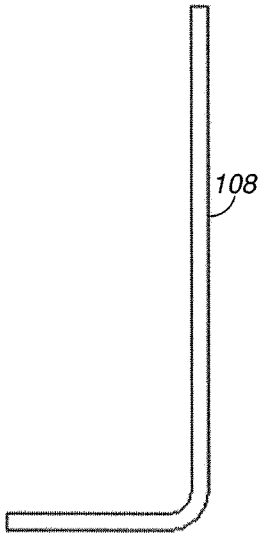

FIGS. 3A, 3B, and 3C respectively show top-front, front, and side views of the backplate 108. The backplate 108 is a rigid element and can include a variety of through holes, such as through holes 110, for allowing the latch assembly 100 to be mounted to a support structure, such as the post 102, a wall, or other such structure. The shape of the backplate can vary. The illustrated embodiment of the backplate 108 has an L-shaped cross section. Alternatively, multiple plates can be assembled to arrive at the L-shaped configuration of the backplate 108.

The backplate 108 can be made from any of several suitable rigid materials, such as metal, wood, or ceramic, but is preferably made of metal for outdoor gate applications, for example 7 gauge hot rolled steel. The size of the backplate 100 can vary according to the size of the latch assembly 100, which in turn can vary in size depending on the application. For example, a relatively larger latch 100 would be preferred for a gate and a relatively smaller latch 100 would be preferred for a small cabinet. For example, in an exemplary embodiment that would be suitable for use with a gate, the backplate 108 can be approximately 7½ inches tall and 3½ inches wide. There is a 90-degree bend in the backplate 108. The location of the bend line can vary, but in the exemplary embodiment, the bend is centered about 2 inches measured up from the bottom edge of the backplate 108. The holes 110 are provided above the bend line. The two round holes 110 down the center line of the backplate 108 can be used as mounting holes, for example for using 5/16-inch lag bolts or 5/16 threaded machine bolts to mount the backplate 108 to a supporting surface, pole, or post, for example a square or round wooden post. The four slotted holes 110 additionally can be used with four mounting bolts or with other mount types such as saddle clamps (not shown) and can mount the backplate 108 to various sizes of tubular pipe. In some embodiments, saddle clamps can range in size from 1½" to 2½" and can allow the latch assembly 100 to be used with residential fences, commercial fences and dog kennels. The backplate 108 also includes a through-hole 111. The hole 111 is square in the illustrated embodiment, but other shapes can be used, such as a keyed-circle. The hole 111 allows for a bolt 126 to extend through the backplate 108 for attaching the lock lever 106 to the backplate 108. The hole 111 is preferably non-circular in shape so that the bolt 126 will not rotate relative to the backplate 108.

The backplate 108 additionally has five through-holes below the bend line: two rectangular slots 112, two smaller round holes 114, and a somewhat centrally located round hole 116. The rectangular slots 112 receive the two fork like tines 118 on the bottom end of the lock lever 106. The two smaller round holes 114 allow the use of pad locks from either side of the latch assembly 100. The central round hole 116 allows the pivot bolt 120 to pass through the backplate 108 in order to attach the latch member 109 to the backplate 108 and provide a pivot point for the latch member 109 relative to the backplate 108.

Figure 4A:
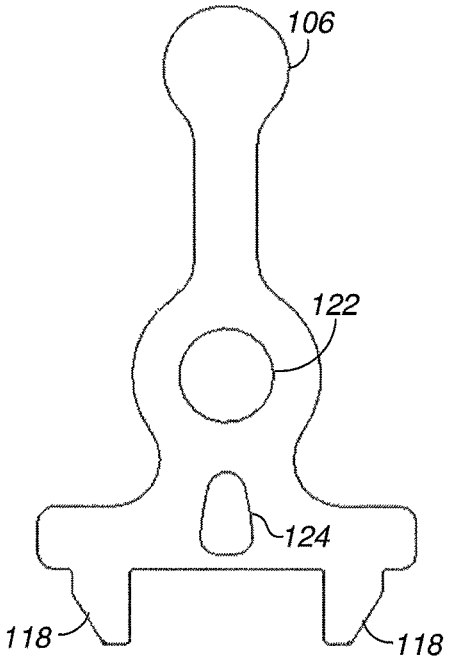
FIGS. 4A and 4B respectively show front and side views of a lock lever of the latch assembly shown in FIG. 1 according to a first embodiment of the present disclosure.
Figure 4B:
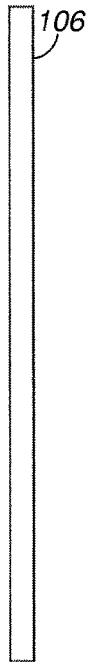

FIGS. 4A and 4B respectively show front and side views of the lock lever 106. The lock lever 106 can also be made from metal, for example 7 gauge hot rolled steel. In an exemplary embodiment, the lock lever 106 can be a little over 5" tall and 3" wide. The large round head shape at the top is for ergonomic finger comfort when actuating the latch assembly 100. The large centrally located hole 122 allows for the insertion of a mounting bolt through the bottom mounting hole 110 of the backplate 108. The hole 122 is preferably large enough to allow the insertion of a tool, such as a ½" socket, for tightening a mounting bolt. The arch-shaped slot 124 is a through-hole that allows for mounting the lock lever 106 to the backplate 108 using a bolt 126. The two fork-like tines 118 on the bottom end of the lock lever 106 are configured to be insertable into respective rectangular slots 112 of the backplate 108.

Figure 5:
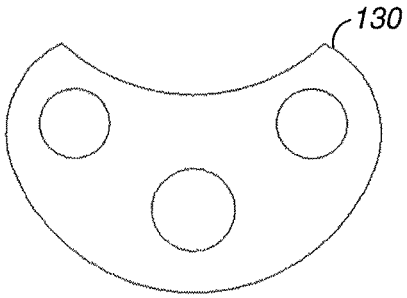
FIG. 5 shows a top view of a lube pad of the latch assembly shown in FIG. 1 according to a first embodiment of the present disclosure.

FIG. 5 shows a top view of an optional lube pad 130 that can be included in the latch assembly 100 between the backplate 108 and the latch member 109 in order to reduce friction between the backplate 108 and the latch member 109. The lube pad 130 can be formed from any suitable material having a low coefficient of friction, for example a plastic material such as polyethylene. In an exemplary embodiment, the lube pad 130 is formed of Ultra-high-molecular-weight (UHMW) polyethylene.

Figure 6A:
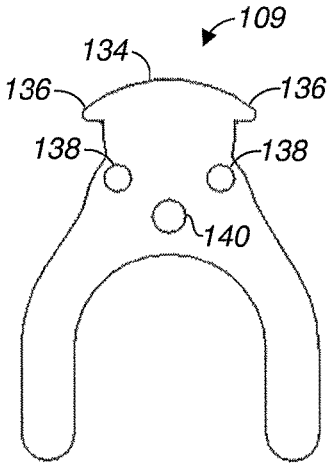
FIGS. 6A and 6B respectively show front and side views of a rotating latch member of the latch assembly shown in FIG. 1 according to a first embodiment of the present disclosure.
Figure 6B:
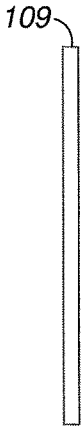

FIGS. 6A and 6B respectively show front and side views of the latch member 109. The latch member 109 can also be made from metal, for example 7 gauge hot rolled steel. In an exemplary embodiment, the latch member 109 can be approximately 4⅜" long and approximately 3 7/16" wide. As viewed in the latch assembly 100, the latch member 109 fits underneath the bottom of the backplate 108 and sits horizontally with the U-shaped section extending away from the backplate 108. The latch member 109 has a back edge 134 that has a large radius of curvature between two tabs 136. The purpose of the tabs 136 is explained below in connection with the description of the operation of the latch assembly 100. The holes 138 extend through the latch member 109 in order to allow the use of pad locks from either side of the latch assembly 100 for locking the latch assembly 100. The central hole 140 extends through the latch member 109 and allows the pivot bolt 120 to pass through the latch member 109 in order to attach the latch member 109 to the backplate 108 and provide a pivot point for the latch member 109 relative to the backplate 108.

Referring back again to FIGS. 2A, 2B, and 2C, the components of the latch assembly 100 can be assembled as follows. The bolt 126 extends through the hole 111 in the backplate 108 from the back side of the plate 108 (towards the lock lever 106). The bolt 126 can be a metal bolt, for example a flat head carriage bolt. In the exemplary embodiment, the bolt 126 is a ¼–20×1¼" flat head carriage bolt. The bolt 126 preferably is keyed to match the shape of the hole 111 so that the bolt 126 will not rotate relative to the backplate 108. A hex nut 144 (shown in phantom in FIG. 2B because it is obscured by the spacer 146) is threaded onto the bolt 126 and tightened. A nylon spacer 146 is slipped over the bolt 126 and the hex nut 144, and is flush against the backplate 108. The tines 118 of the lock lever 106 extend into respective ones of the two rectangular slots 112 in the backplate 108 and the bolt 126 extends through the hole 124 of the lock lever 106. A fender washer 152 and a lock nut 154 are assembled onto the bolt 126 in order to secure the lock lever 106 relative to the backplate 108. Preferably the nut 154 is tightened so as to leave a gap between the washer 152 and the nut 154 for allowing the lock lever 106 to move up and down freely under the force of gravity.

The pivot bolt 120 secures the backplate 108 to the latch member 109. A compression spring 160 extends about the shaft of the pivot bolt 120 between the head of the pivot bolt 120*a* and the upper surface of the lower portion of the backplate 108. The spring 160 can be, for example, a stainless steel spring sized to fit about the shaft of the pivot bolt 120. The pivot bolt 120 extends through the spring 160, and then through the hole 116 in the backplate 108, and then through the hole 140 in the latch member 109. If a lube pad 130 is used, the pivot bolt 120 will extend through the lube pad 130 between the hole 116 of the backplate and the hole 140 of the latch member 109. A washer 162, for example a nylon 66 Molybdenum Disulfide (MDS) washer, and a lock nut 164 are attached to the bottom end of the pivot bolt 120 to secure the pivot bolt 120 to the backplate 108 and latch member 109. The lock nut is preferably tightened until the end of the of the pivot bolt 120, the washer 162, and the lock nut 164 are flush against each other. This will compress the spring 160, giving it a desired compressional load. In an exemplary embodiment, the spring 160 is compressed to have about a 21 lb. load.

Figure 7A:
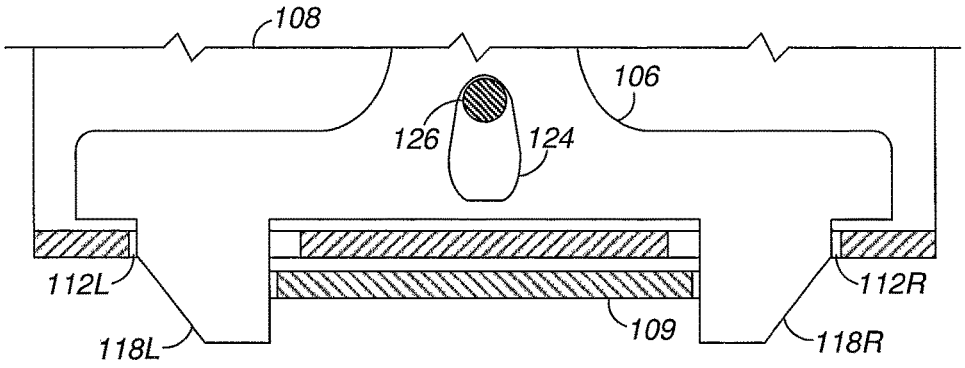
FIGS. 7A-7C show partial sectional views of the latch assembly taken along section line VII-VII in FIG. 2C.
Figure 7B:
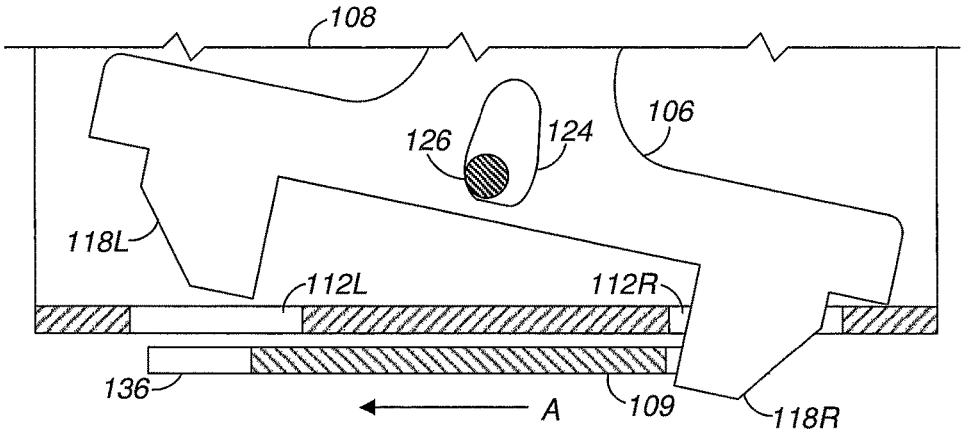
Figure 7C:
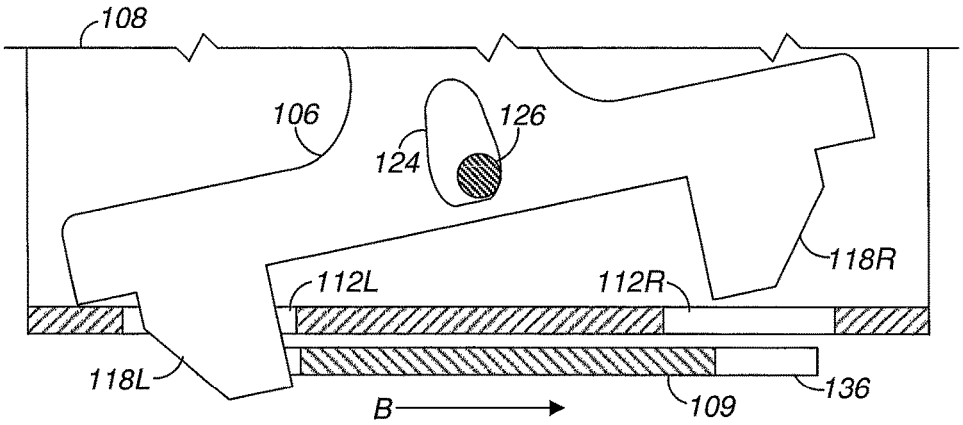
Figure 8A:
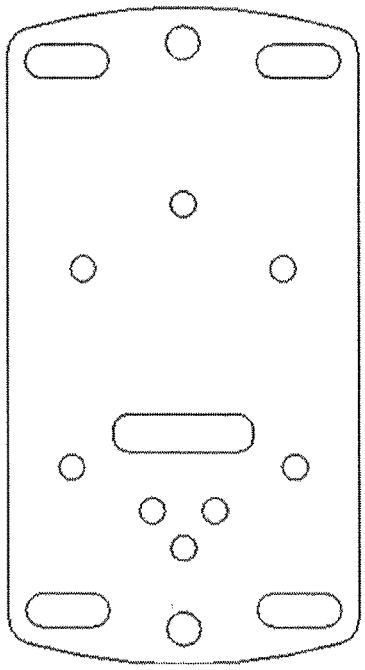
FIGS. 8A and 8B respectively show front and side views of a backplate of a latch assembly (shown in FIGS. 13A-13C) according to a second embodiment of the present disclosure.
Figure 8B:
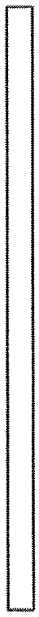
Figure 9A:
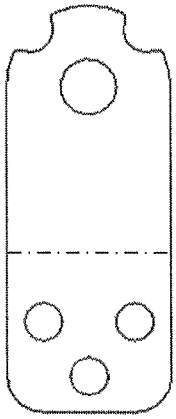
FIGS. 9A, 9B, and 9C respectively show top-front, front, and side views of a pivot bracket of the latch assembly (shown in FIGS. 13A-13C) according to the second embodiment of the present disclosure.
Figure 9B:
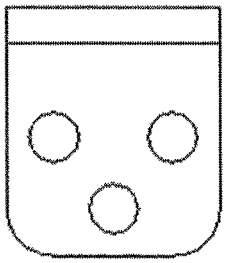
Figure 9C:
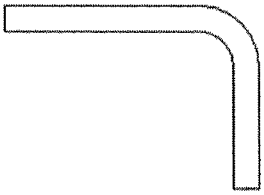
Figure 10A:
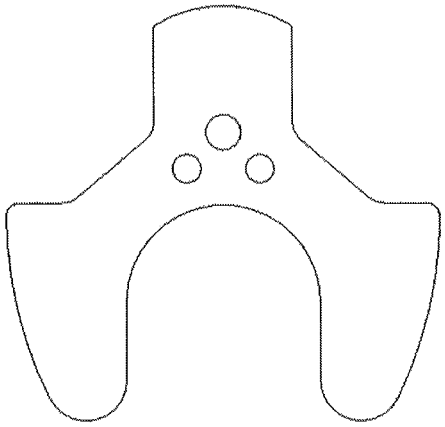
FIGS. 10A and 10B respectively show front and side views of a rotating latch member of the latch assembly (shown in FIGS. 13A-13C) according to the second embodiment of the present disclosure.
Figure 10B:
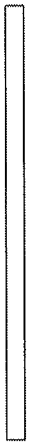
Figure 11A:
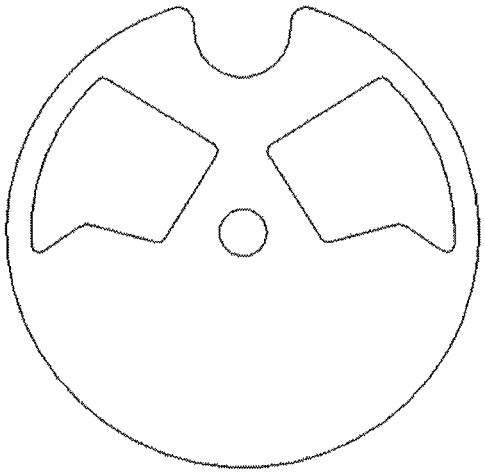
FIGS. 11A and 11B respectively show front and side views of a round lever of the latch assembly (shown in FIGS. 13A-13C) according to the second embodiment of the present disclosure.
Figure 11B:
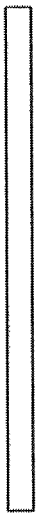
Figure 12A:
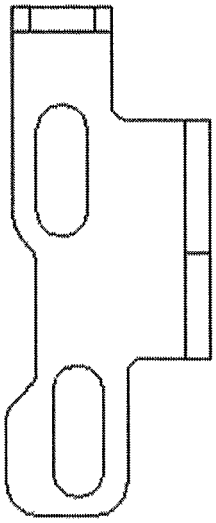
FIGS. 12A, 12B, and 12C respectively show front, side, and top views of a slide lock of the latch assembly (shown in FIGS. 13A-13C) according to the second embodiment of the present disclosure.
Figure 12B:
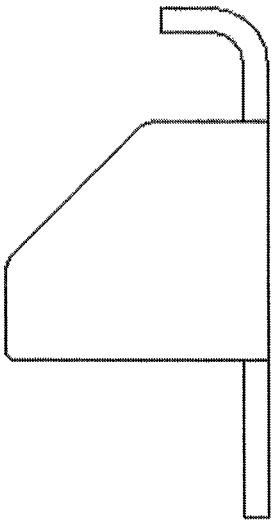
Figure 12C:
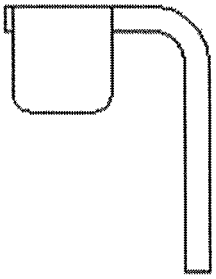
Figure 13A:
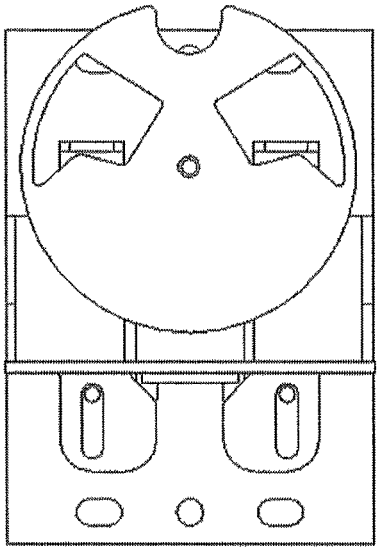
FIGS. 13A, 13B, and 13C respectively show front (latch not rotated), front (latch rotated), and top views of the latch assembly according to the second embodiment of the present disclosure.
Figure 13B:
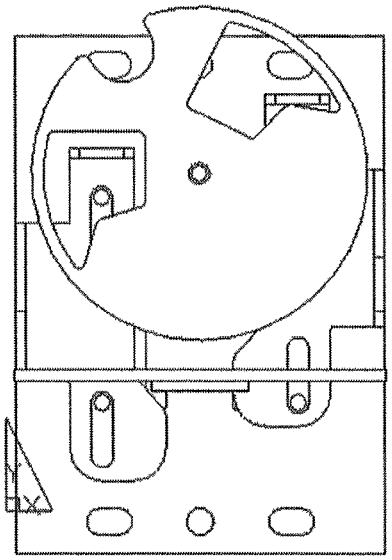
Figure 13C:
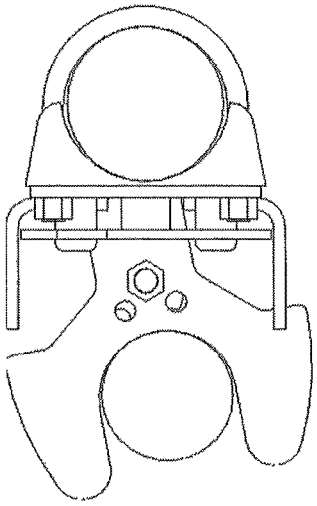

Referring now also to FIGS. 7A-7C, the latch assembly 100 operates as follows. FIG. 7A shows the latch assembly 100 in the locked configuration. While the latch assembly 100 is in the locked configuration, the tines 118 both extend through respective slots 112 to opposing sides of the latch member 109. As a result, the tines 118 block the latch member 109 from pivoting about the pivot bolt 120 relative to the backplate 108.

Tilting the lock lever 106 allows the latch assembly 100 to be transitioned from the locked configuration shown in FIG. 7A to an unlocked configuration shown in FIG. 7B or FIG. 7C, depending on which direction the lock lever is tilted. In other words, referring to FIG. 1, this embodiment of the latch assembly 100 can be unlocked to push the gate 104 open or can be unlocked to pull the gate 104 open.

Tilting the lock lever 106 to the right as shown in FIG. 7B from the locked configuration shown in FIG. 7A causes the lock lever 106 to pivot on its bottom right edge as the left side tine 118L lifts out of its slot 112L. The right tine 118R pivots in its rectangular slot 112R and pushes on the right edge of the latch member 109 in the direction indicated by arrow A. This causes the latch member 109 to rotate about the longitudinal axis of the pivot bolt 120 and causes the U-shaped opening to move to the right while the back side of the latch member 109 moves to the left. The latch assembly at this point is in an unlocked configuration.

Tilting the lock lever 106 to the left as shown in FIG. 7C from the locked configuration shown in FIG. 7A causes the lock lever 106 to pivot on its bottom left edge as the right side tine 118R lifts out of its slot 112R. The left tine 118L pivots in its rectangular slot 112L and pushes on the left edge of the latch member 109 in the direction indicated by arrow B. This causes the latch member 109 to rotate about the longitudinal axis of the pivot bolt 120 and causes the U-shaped opening to move to the left while the back side of the latch member 109 moves to the right. The latch assembly at this point is in an unlocked configuration.

The gate 104, a portion of which is within the U-shaped opening of the rotating latch, can now be pushed opened. The gate 104 continues to rotate the latch member 109 until the gate 104 finally leaves the U-shaped opening to fully open the gate 104. Note that the arched-shaped slot 124 in the lock lever 106 allows the lock lever 106 to pivot on its left or right bottom edge while limiting how far the lever can tilt from side to side.

While the gate 104 is being closed it re-enters the U-shaped opening of the latch member 109 and causes the latch member 109 to rotate about the longitudinal axis of the bolt 120 until the latch assembly 100 returns to a locked configuration. Thus, the latch assembly 100 can be transitioned from either of the unlocked configurations shown in FIGS. 7B and 7C to the locked configuration shown in FIG. 7A. Releasing the lock lever 106 causes the raised tine 118 to drop back into its rectangular slot 112, but while the latch member 109 is rotated to the right or left, the tine 118 will be blocked by the latch member 109 keeping it from relocking.

For example, if the latch assembly 100 is in the unlocked configuration shown in FIG. 7B, the travel of the left side tine 118L is limited by the latch member 109—the latch member 109 blocks the left side tine 118L from dropping beyond the bottom edge of the left side slot 112L. Note that the tab 136 on the left side of the latch member 109 also partially blocks the travel of the left side tine 118L by at least partially blocking the bottom side of the left slot 112L while the latch member 109 is rotated. This is because the rotation of the latch member 109 causes the left tab 136 to rotate to a position at least partially aligned with the left slot 112L. As the latch member 109 starts to rotate about the longitudinal axis of the pivot bolt 120, the back side of the latch member 109 moves opposite the direction indicated by arrow A until the latch member reaches the position shown in FIG. 7A and the left slot 112L is no longer blocked by the latch member 109. The lock lever 106 then drops under the force of gravity thereby allowing the tines 118 to settle back down into their respective slots 112. Thus, the latch member is once again prevented from pivoting as described above in connection with FIG. 7A until the lock lever 106 is tilted in either direction lifting one or the other tines 118 out of its respective slot 112.

Similarly, if the latch assembly 100 is in the unlocked configuration shown in FIG. 7C, the travel of the right side tine 118R is limited by the latch member 109—the latch member 109 blocks the right side tine 118R from dropping beyond the bottom edge of the right slot 112R. Note that the tab 136 on the right side of the latch member 109 also partially blocks the travel of the right side tine 118R by at least partially blocking the bottom side of the right slot 112R while the latch member 109 is rotated. This is because the rotation of the latch member 109 causes the right tab 136 to rotate to a position at least partially aligned with the right slot 112R. As the latch member 109 starts to rotate about the longitudinal axis of the pivot bolt 120, the back side of the latch member 109 moves opposite the direction indicated by arrow B until the latch member reaches the position shown in FIG. 7A and the right slot 112R is no longer blocked by the latch member 109. The lock lever 106 then drops under the force of gravity thereby allowing the tines 118 to settle back down into their respective slots 112. Thus, the latch member is once again prevented from pivoting as described above in connection with FIG. 7A until the lock lever 106 is tilted in either direction lifting one or the other tines 118 out of its respective slot 112.

Thus, the disclosed latch assembly advantageously can be unlocked, and remain unlocked, with a single push of the lock lever. Leaving the latch unlocked frees up the same hand to now push the gate open. Once the gate is returned to its original position, the latch will relock quietly and smoothly with little effort. No slamming, two handed operation or using your foot is required. Many gates will sag over time, but the disclosed latch assembly advantageously uses the U-shaped rotating latch so that gate sag has no effect on how it operates. It will always open smoothly and easily.

It will be appreciated by those skilled in the art that alternative embodiments are possible without departing from the spirit and scope of the present disclosure. For example, FIGS. 8A-13C show an alternative embodiment of a latch assembly. The alternative embodiment can be made of metal components and can operate in a manner similar to the first embodiment disclosed above in connection with FIGS. 1A-7B.

The particular embodiments disclosed above are illustrative only, as the application may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the application. Accordingly, the protection sought herein is as set forth in the claims below. It is apparent that a system with significant advantages has been described and illustrated. Although the system of the present application is shown in a limited number of forms, it is not limited to just these forms, but is amenable to various changes and modifications without departing from the spirit thereof.

What is claimed is:

1. A latch assembly comprising:

a backplate having first and second slots;

a lock lever attached to the backplate and free to move relative to the backplate;

the lock lever including first and second tines sized to fit into the first and second slots, respectively; and a latch member attached to the backplate;

wherein the latch assembly is operable between a locked configuration in which the first and second tines are disposed within the first and second slots, respectively, and an unlocked configuration in which at least one of the first or second tines is not disposed within the first or second slot, respectively;

wherein the latch member is free to move relative to the backplate while the latch assembly is in an unlocked configuration;

wherein the latch member is prohibited from to moving relative to the backplate by the lock lever while the latch assembly is in a locked configuration.

2. The latch assembly of claim 1, wherein the first and second tines extend along opposing sides of the latch member while the latch assembly is in the locked configuration.

3. The latch assembly of claim 2, wherein only one of the first and second tines extends along a side of the latch member while the latch assembly is in the unlocked configuration.

4. The latch assembly of claim 2, wherein, while the latch assembly is in the unlocked configuration, the latch member limits the travel of at least one of the first and second tines.

5. The latch assembly of claim 1, further comprising a pivot bolt extending through the latch member and the backplate.

6. The latch assembly of claim 5, further comprising a compression spring extending about a shaft of the pivot bolt.

7. The latch assembly of claim 1, further comprising a bolt extending through the lock lever and the backplate.

8. A latch assembly comprising:

a backplate having an L-shaped cross section, a first slot, and a second slot;

a latch member attached to the backplate; and a lock lever having a first tine and a second tine, the lock lever being attached to the backplate and free to move between a locked configuration in which the first and second tines are disposed within the first and second slots, respectively, and an unlocked configuration in which at least one of the first or second tines is not disposed within the first or second slot, respectively wherein, while the lock lever is in the locked configuration, the first and second tines of the lock lever extend through the first and second slots, respectively, and along opposing sides of the latch member, thereby limiting movement of the latch member relative to the backplate.

9. The latch assembly of claim 8, wherein, while the lock lever is in the unlocked configuration, the latch member limits the travel of at least one of the first and second tines.

10. The latch assembly of claim 8, further comprising a pivot bolt extending through the latch member and the backplate.

11. The latch assembly of claim 10, further comprising a compression spring extending about a shaft of the pivot bolt.

12. The latch assembly of claim 8, further comprising a bolt extending through the lock lever and the backplate.

13. A method of manufacturing a latch assembly, comprising:

attaching a lock lever to a backplate such that the lock lever is free to move relative to the backplate;

forming first and second slots through the backplate;

forming first and second tines on the lock lever, such that the first and second tines are sized to fit into the first and second slots, respectively; and attaching a latch member to the backplate such that:

the latch member is free to move relative to the backplate while the latch assembly is in an unlocked configuration in which at least one of the first or second tines is not disposed within the first or second slot, respectively; and the latch member is prohibited from to moving relative to the backplate by the lock lever while the latch assembly is in a locked configuration, in which the first and second tines are disposed within the first and second slots, respectively.

14. The method of claim 13, wherein, while the latch assembly is in the locked configuration, the first and second tines extend into the first and second slots, respectively, and along opposing sides of the latch member.

15. The method of claim 13, wherein, while the latch assembly is in the unlocked configuration, only one of the first and second tines extends along a side of the latch member and the latch member limits the travel of at least one of the first and second tines.

16. The method of claim 13, further comprising:

attaching the latch member to the backplate with a pivot bolt; and extending a compression spring about a shaft of the pivot bolt.

17. The method of claim 13, further comprising attaching the lock lever to the backplate with a bolt.

* * * * *